United States Patent [19]

Meacham

[11] 4,280,540

[45] Jul. 28, 1981

[54] LOG SPLITTER

[76] Inventor: G. B. Kirby Meacham, 47 Black Rock Rd., Cohasset, Mass. 02025

[21] Appl. No.: 7,954

[22] Filed: Jan. 31, 1979

[51] Int. Cl.[3] ..... B27L 7/00

[52] U.S. Cl. ..... 144/193 C; 144/193 R; 173/91

[58] Field of Search ..... 144/193 R, 193 C, 193 D, 144/193 B; 254/104; 173/90, 91, 93, 93.7; 81/52.35

[56] References Cited

U.S. PATENT DOCUMENTS

| | | | |
|---|---|---|---|
| 1,304,528 | 5/1919 | Anderson | 144/193 B |
| 3,050,095 | 8/1962 | Prather | 144/193 R |
| 3,377,052 | 4/1968 | Hagen | 254/104 |

FOREIGN PATENT DOCUMENTS

| | | | |
|---|---|---|---|
| 26353 | 12/1953 | Finland | 144/193 D |
| 48054 | 2/1964 | Poland | 144/193 B |

*Primary Examiner*—W. D. Bray
*Attorney, Agent, or Firm*—Robert T. Gammons

[57] ABSTRACT

A log splitter comprising in combination a support, a wedge mounted to the support for vertical movement relative thereto, a hammer bar supported in vertical alignment with the wedge for reciprocal movement relative thereto on the one hand to be raised away from the wedge and on the other hand to be impelled into engagement with the wedge and handle bars at the upper end of the hammer bar for lifting the hammer bar away from the wedge and impelling it into engagement with the wedge.

14 Claims, 12 Drawing Figures

LOG SPLITTER

BACKGROUND OF INVENTION

Four types of tools are generally available for splitting logs into firewood:

Wedge type power splitters typically employ a hydraulic ram which drives a wedge the length of the log. Pressure is generated by an engine powered pump and controlled by valves. This type of power splitter is fast and easy to use, but costs $300 and up and is so heavy that a trailer is needed to transport it to the job site. Because of its high productivity, it is favored by professional woodcutters. Such units are available to occasional users on a rental basis.

Screw type power splitters consist of a tapered auger which is driven by the wheel of a jacked up truck or a tractor power takeoff. The side of the log is pushed against the point of the auger with the end of the log bearing against the ground to provide a torque reaction point. The auger screws through the wood and splits the log. Cumbersome setup and operating hazards are the major objections to this method.

A sledge hammer or maul and wedges or an axe are the lowest cost tools for wood splitting. They have disadvantages, however:

A certain skill is required to hit the mark consistently.

The process can be dangerous, particularly for the unskilled. Flying wedges or glancing axe blows endanger legs and feet.

A minimum strength level, particularly with a splitting maul or axe, is required since a blow lighter than sufficient to split the wood has no useful effect and is wasted.

Several products are available consisting of a wedge which is guided by a vertical slide and driven into the end of the log with a sledge hammer. The advantage is that the wedge and log are held in the proper relation to each other, and the danger of a flying wedge is avoided. The user must still, however, have the skill and strength to drive the wedge. In addition, if the wedge is driven its full depth (about 9 inches) without splitting the log, extracting the wedge can be a problem.

The concept described in this disclosure is basically in the guided wedge category. Its advantages over existing designs include a built-in hammer and the capability of driving the wedge the full length of a difficult log.

SUMMARY OF INVENTION

A log splitter comprising in combination a support, a wedge mounted to the support for vertical movement relative thereto, a hammer bar supported in vertical alignment with the wedge for reciprocal movement relative thereto on the one hand to be raised away from the wedge and on the other hand to be impelled into engagement with the wedge and means for lifting the hammer bar away from the wedge and impelling it into engagement with the wedge. The support contains a vertically-oriented opening for receiving the wedge and the wedge, in turn, contains a vertically-oriented opening for receiving the hammer bar. The wedge includes a sleeve to the lower end of which the wedge is fixed and the hammer bar is mounted in the sleeve. The means for lifting the hammer bar and impelling it into engagement with the wedge comprise handle bars fixed to the upper end thereof. Desirably, the wedge and hammer bar are removably mounted to the support and the hammer bar is inseparably connected to the wedge by means of a guide pin fixed to the sleeve and extending into a slot lengthwise of the hammer bar, the opposite ends of which are closed. The aforesaid guide pin prevents rotation of the hammer bar within the sleeve. There is also means fixed to the sleeve to limit the rotation thereof relative to the support and for limiting downward movement of the sleeve and hammer bar relative to the support. The sleeve and hammer bar may be of circular cross section or the sleeve may be of rectangular cross section and the hammer bar of circular cross section. The hammer bar in this case is provided with a lug for preventing rotation within the sleeve. The support comprises a base block of sufficient area to receive the end of a log to be split and guide means above it supporting the wedge and hammer bar for vertical movement. The guide means comprising alternatively a guide sleeve disposed with its axis perpendicular to the base or vertically-spaced guide rings.

The invention will now be described in greater detail with reference to the accompanying drawings, wherein:

FIG. 1 diagrammatically illustrates the log splitting device in front elevation;

Figure 1:
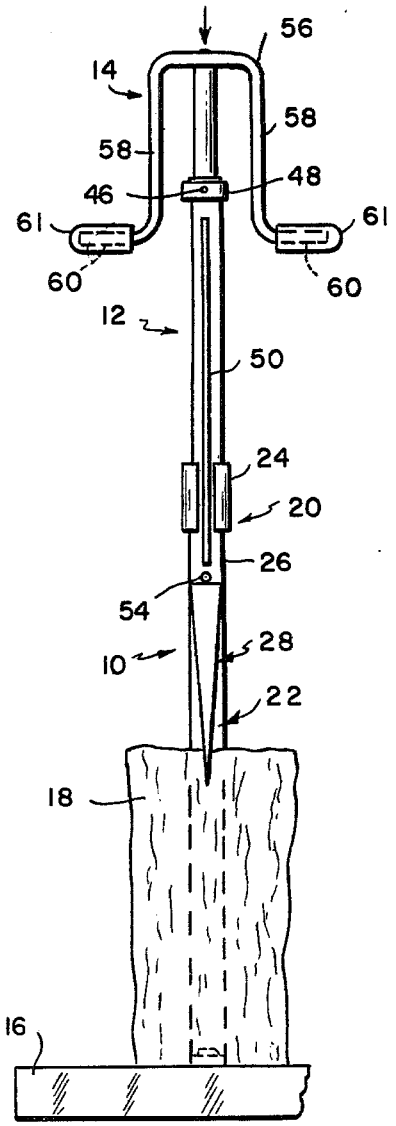
Figure 2:
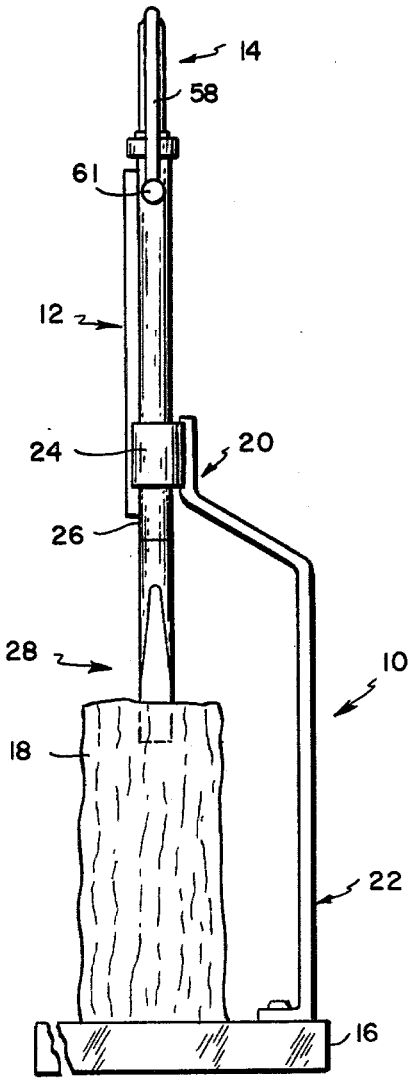
FIG. 2 is a side elevation of FIG. 1.
Figure 2A:
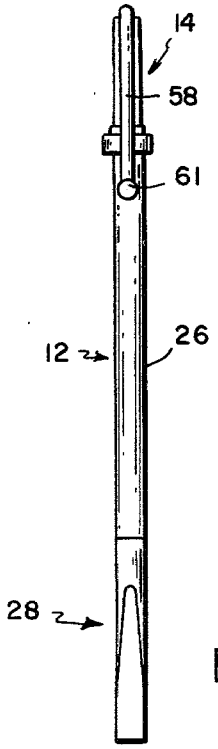
FIG. 2A is an elevation of the hammer bar wedge assembly removed from the support.
Figure 3:
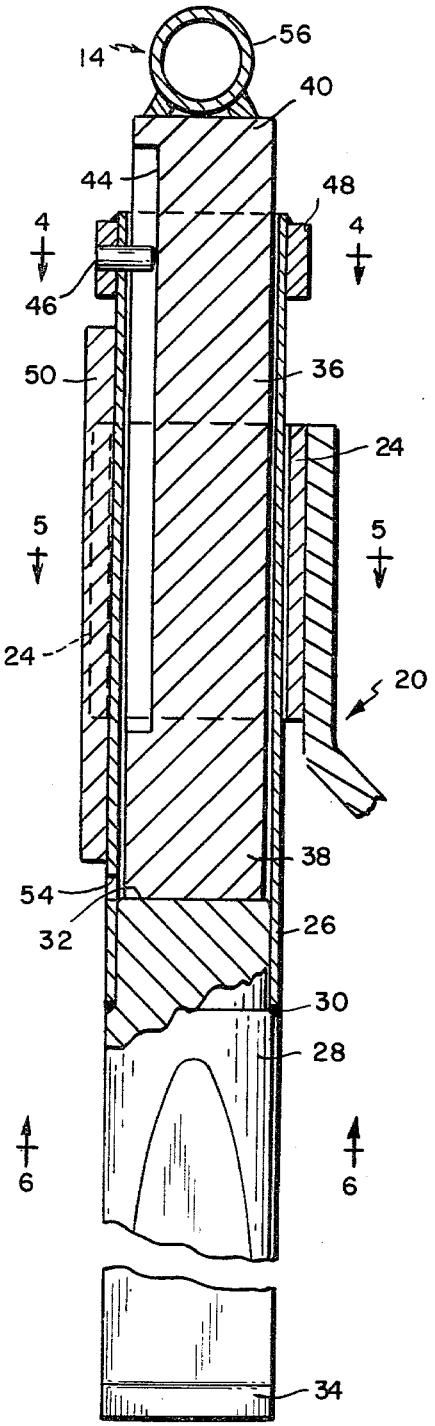
FIG. 3 is a framentary elevational view to larger scale.
Figure 4:
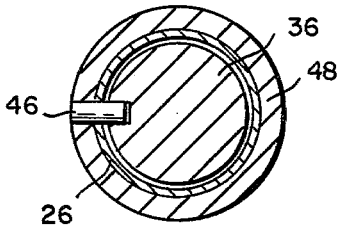
FIG. 4 is a horizontal section taken on the line 4—4 of FIG. 3.
Figure 5:
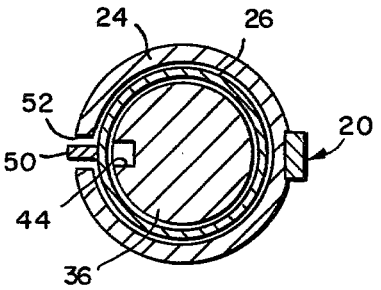
FIG. 5 is a horizontal section taken on the line 5—5 of FIG. 3.
Figure 6:
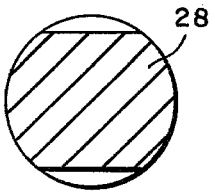
FIG. 6 is a horizontal section taken on the line 6—6 of FIG. 3.
Figure 7:
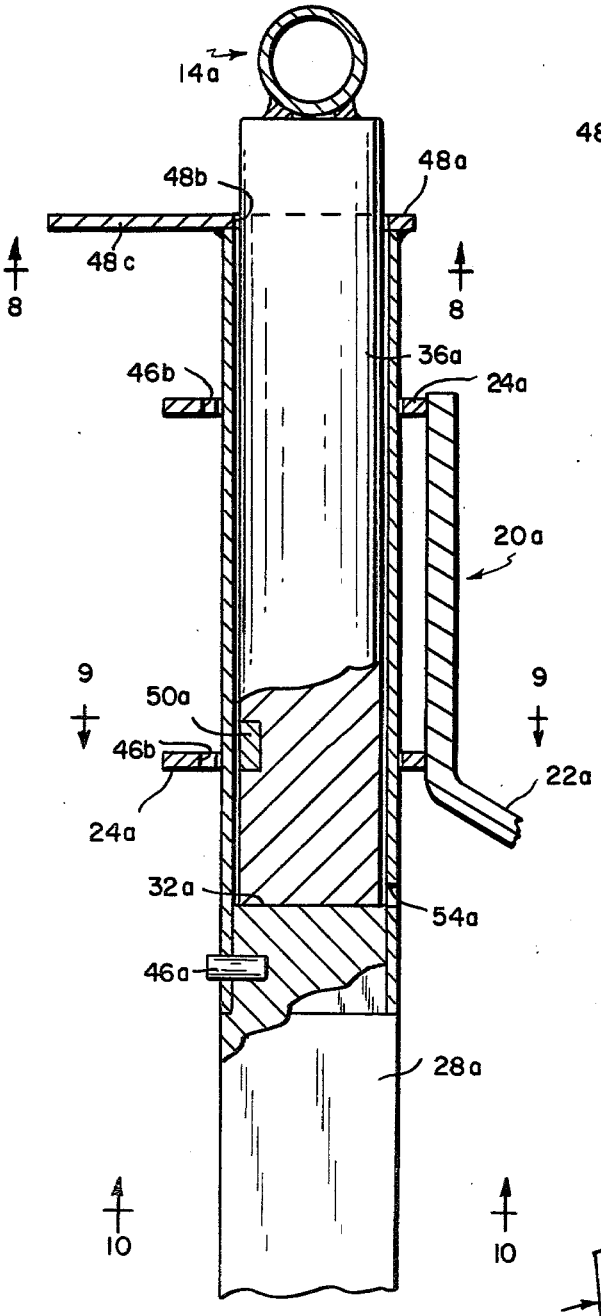
FIG. 7 is a fragmentary elevational view of an alternative construction.
Figure 8:
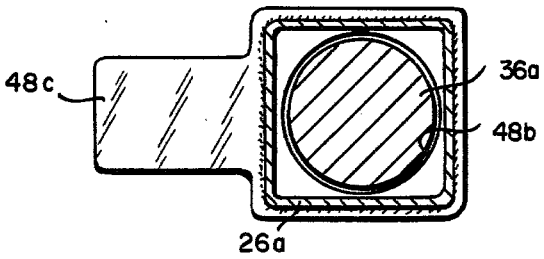
FIG. 8 is a horizontal section taken on the line 8—8 of FIG. 7.
Figure 9:
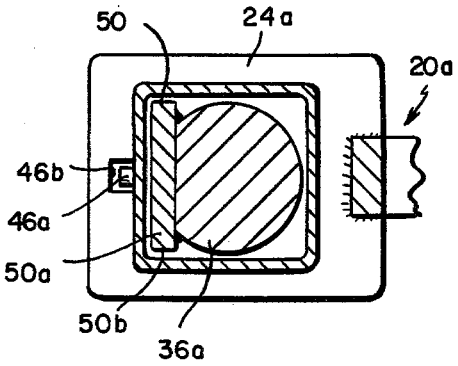
FIG. 9 is a horizontal section taken on the line 9—9 of FIG. 7.
Figure 10:
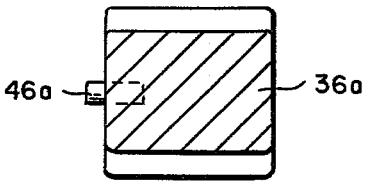
FIG. 10 is a horizontal section taken on the line 10—10 of FIG. 7.

Referring to the drawings, FIGS. 1 and 2, the log splitting device of this invention comprises essentially a supporting structure 10, a hammer bar wedge assembly 12, and an operating handle 14. The supporting stand 10 is provided with a broad base block 16, for example, of a relatively thick block of wood upon which a log 18 may be placed in an upright position, guide means 20 within which the hammer bar wedge assembly is adapted to be supported for vertical movement perpendicularly relative to the base block 16, a stand 22 for supporting the guide means 20 above the base block 16.

Figure 11:
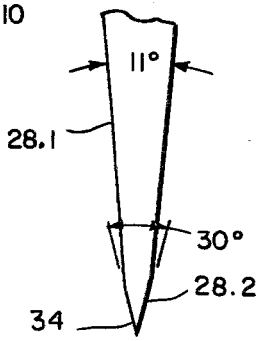
FIG. 11 is a fragmentary elevational view of the lower end of the wedge.

Referring specifically to FIGS. 3 to 6 inclusive, the guide means 20 at the upper end of the stand 22 is in the form of a guide sleeve 24 welded to the upper end of the stand with its axis perpendicular to and in alignment with the base. The hammer bar wedge assembly is supported within the guide sleeve 24 for vertical movement therein to enable adjusting the lower end of the wedge to the perpendicular height of the log and comprises a guide tube 26 slidably mounted within the guide sleeve 24 for vertical movement relative thereto within the lower end of which is fixed a wedge 28 as, for example, by welding 30. The upper end 32 of the wedge provides a flat impact surface perpendicular to its axis and the lower end, FIG. 11, is tapered to a cutting edge 34. As shown, the wedge 28 is formed by tapering the opposite diametrical sides of a length of cylindrical stock so as to have a first tapered portion 28.1 of 11° included angle and a second tapered portion 28.2 of 30° included angle. Desirably, the intersections of the flat surfaces of the tapered portion 28.1 with the flat surface of the tapered portion 28.2 are made rounded. Within the guide tube 26 above the shank of the wedge is mounted a hammer bar 36 which is of circular cross section with its lower end 38 resting on the impact surface 32 and with its upper end 40 rising above the upper end of the guide tube 26. The manner bar 36 contains longitudinally thereof a milled slot 44 and a guide pin 46 is fixed to the sleeve so as to project inwardly through it into the slot 44 to thus limit and prevent withdrawal of the hammer bar from the guide tube and, at the same time, to prevent rotation of the hammer bar within the guide tube. As thus constructed, it is possible to withdraw a wedge from a partially split log by raising the hammer bar so as to strike the pin 46. Desirably, the upper end of the guide tube 26 is reinforced by means of a ring 48 applied to the outer side and welded thereto and the pin 46 is fixed within this ring. The ring 48 serves also to limit downward movement of the guide tube within the guide sleeve. Rotation of the guide tube within the guide sleeve is prevented by a spline 50 welded to the guide tube in a position to extend radially therefrom through a slot 52 in the guide sleeve.

There are one or more ports or vent holes 54 through the wall of the guide tube 26 adjacent the lower end substantially at the level of the impact surface within the guide tube to permit air to escape from the guide tube as the hammer bar is driven downwardly therein.

The operating handle 14 is mounted to the upper end of the hammer bar and is of inverted U-shaped configuration comprising a horizontal part 56 welded to the top of the hammer bar, spaced, parallel, downwardly-extending portions 58—58 at opposite ends of the part 56, and outwardly-extending, horizontal handles 60—60 at the lower ends of the part 58—58 provided with shock-absorbing grips 61—61.

In the structure described above with reference to FIGS. 3 to 6, the guide sleeve, guide tube and hammer bar are all of circular cross section. FIGS. 7 to 10 inclusive show a modification in which the guide means **20*a* comprise vertically-spaced rings 24*a*—24*a* containing rectangular openings welded to the stand 22*a* in place of the guide sleeve 24. The guide tube 26*a* is of rectangular cross section and is slidable vertically in the rings 24*a*—24*a*. The hammer bar is of circular cross section and is prevented from rotating in the guide tube by a guide lug 50*a* welded to the hammer bar within the guide tube with its opposite ends 50*b*—50*b* adjacent the opposite parallel sides of the guide tube. An index pin 46*a* fixed in the guide tube provides in conjunction with index slots 46*b*—46*b* in the guide rings means for inserting the guide tube hammer bar assembly into the support stand in the proper orientation. A flat plate 48*a* containing a circular hole 48*b* corresponding in cross section to the hammer bar welded to the upper end of the guide tube limits downward movement of the guide tube within the guide sleeve, prevents the hammer bar from being withdrawn from the guide tube and also provides means for withdrawing the wedge from a log by impact of the lug 50*a* with the plate 48*a*. An extension 48*c* of the plate 48*a* serves as a handle for lifting the guide tube together with the wedge and hammer bar to position the wedge at the upper end of the log to be split. Rotation of the guide tube 26*a* within the guide rings 24*a*—24*a* is prevented by the square guide tube sliding in the square holes in the guide rings. The operating handle 14*a* is welded to the upper end of the hammer 36*a*, is of inverted U-shaped configuration and, like that shown in FIG. 4**, has transversely-spaced, outwardly-extending handles with shock-absorbing grips not shown.

The hammer bar and handle weigh approximately 15 pounds; the maximum stroke of the hammer bar is approximately 18 inches; the included angle of the edge of the wedge is approximately 30°; and the maximum width of the cutting edge is approximately $1\frac{3}{4}$ inches. The base block is preferably comprised of two layers of wood laid at right angles and nailed and, desirably, is 20 inches wide by 26 inches long by $3\frac{1}{4}$ inches thick. The wedge and hammer bar are made from medium carbon 4140 heat-treated steel; the support stand of medium carbon 1044 steel rolled with cold formed bends and is preferably about $\frac{1}{2}$ by 1 inch in cross section; the wedge travel is about 21 inches and, when lifted, provides a space to accommodate a 24 inch log. At its lowermost position, the wedge is stopped about 2 inches above the base block.

To use the log splitting device, a log is placed upright on the base block and the wedge is positioned on the upper end of the log. The hammer bar is then lifted and forcibly slammed down at a velocity substantially higher than would be achieved by a simple gravity drop. The blows are repeated until the wedge is driven far enough into the log to split it. This can range from one blow for wood such as straight grain maple to several dozen blows for elm with knots. Generally, a log can be split using a large number of light blows or fewer heavier blows. Almost any log can be split eventually since the wedge can be driven the length of the log to within about 2 inches of the lower end of the log. When the log splits, the pieces are removed and a new piece is loaded. In the event that the hammer is slammed without a log in place or a log splits suddenly, the hammer bar wedge assembly is stopped by the end stop bottoming on the guide sleeve or top guide ring. The support stand which is made of resilient steel absorbs the blow without damage.

If the wedge becomes stuck in a log, it can be backed out by raising the hammer bar so as to bring the bottom of the slot 44 into impacting engagement with the pin 46 or the lug **50*a* into impacting engagement with the plate 48*a***.

As thus constructed, the guide provides for optimum movement of the hammer bar without pinching, the air vents prevent cushioning so as to enhance the impact and the handles optimize the grip for applying the maximum impact.

Further advantages of the construction are that the wedge hammer bar assembly can be easily removed from the support stand for transportion and storage, the hammer bar is retained within the hammer guide tube to prevent accidental disengagement during use or transportation and the consequent inconvenience and hazard and the wedge can be backed out of a log by slamming the hammer bar upwardly against the stop. Pinch points which injure the user are avoided by the arrangement of the handle bars so that the user's hands cannot be trapped between the handle grips and the support stand.

While the device is preferably used in conjunction with a stand, the hammer bar wedge assembly may be removed from the stand and used with good results by placing it upright on the log to be split and, while supporting it upright by holding onto the handles, raising and lowering the hammer bar within the tube so as to strike the upper end of the wedge at the bottom of the tube.

It should be understood that the present disclosure is for the purpose of illustration only and includes all modifications or improvements which fall within the scope of the appended claims.

What is claimed is:

1. A log splitter comprising in combination a wedge having an upper part comprising a driving head and a lower part comprising a tapered blade, a support supporting the wedge with its driving head uppermost for vertical reciprocal movement, a hammer bar, guide means extending upwardly from the driving head of the wedge within which the hammer bar is supported in vertical alignment with the driving head for movement therein relative to the driving head on the one hand to be raised away from the driving head and on the other hand to be impelled into engagement with the driving head and means comprising handlebars fixed to the upper end of the hammer bar at opposite sides thereof for lifting the hammer bar away from the driving head and impelling it into engagement with the driving head.

2. A log splitter according to claim 1 wherein there are shock-absorbing handle grips mounted to the handle bars.

3. A log splitter according to claim 1 wherein the support comprises a base block for receiving a log and guide means above the base block which supports the wedge and hammer bar for vertical movement to enable positioning the lower end of the wedge on the log to be split.

4. A log splitter according to claim 3 wherein the guide means comprises a guide sleeve disposed with its axis perpendicular to the base.

5. A log splitter according to claim 1 wherein there are mutually cooperable means in the support and guide means and on the hammer bar and guide means for preventing withdrawal of the guide means from the support and withdrawal of the hammer bar from the guide means.

6. A log splitter comprising in combination a support comprising vertically-spaced guide rings, a wedge of circular cross section having a diametral cutting edge defined by flat surfaces converging at an included angle of 30°, a tube to the lower end of which the wedge is fixed, said tube supporting the wedge in said guide rings for vertical movement, a hammer bar mounted in said tube for movement therein relative to the wedge at the lower end, said tube being of rectangular cross section and said hammer bar being of circular cross section, a guide lug fixed to the hammer bar with its opposite ends adjacent to the opposite sides of the tube and means for lifting the handlebar away from the wedge and impelling it into engagement with the wedge.

7. A log splitter comprising a wedge, a guide tube to the lower end of which the wedge is fixed, a hammer bar supported within the guide tube in axial alignment with the wedge for reciprocal movement therein relative to the wedge and means for lifting the hammer bar upwardly within the tube away from the wedge and impelling it downwardly within the tube into engagement with the wedge.

8. A log splitter according to claim 7 wherein there is means for preventing withdrawal of the hammer bar from the tube.

9. A log splitter according to claim 8 wherein the means for preventing withdrawal of the hammer bar from the tube provides for applying a withdrawal force to the wedge to withdraw it from the log by impact.

10. A log splitter according to claim 7 wherein there is means for preventing rotation of the hammer bar in the tube.

11. A log splitter according to claim 7 wherein the hammer bar projects from the upper end of the tube and there is a handle bar affixed to the upwardly projecting end of the hammer bar for lifting the hammer bar and slamming it down.

12. A log splitter according to claim 11 wherein there are shock-absorbing grips on the handle bars.

13. A log splitter according to claim 7 wherein the tube contains vent holes at its lower end adjacent the wedge.

14. A log splitter according to claim 7 wherein the shank of the wedge is welded into the lower end of the tube so as to present an impact surface at the bottom of the tube for receiving the impact of the hammer bar.

* * * * *